US012696935B2

(12) United States Patent
Frederick et al.

(10) Patent No.: US 12,696,935 B2
(45) Date of Patent: Aug. 4, 2026

(54) AEROSOL-GENERATING DEVICE WITH OFFSET AIRFLOW CHANNEL

(71) Applicant: PHILIP MORRIS PRODUCTS S.A., Neuchatel (CH)

(72) Inventors: Guillaume Frederick, Les-Geneveys-sur-Coffrane (CH); Ihar Zinovik, Peseux (CH)

(73) Assignee: Philip Morris Products S.A., Neuchatel (CH)

( * ) Notice: Subject to any disclaimer, the term of this patent is extended or adjusted under 35 U.S.C. 154(b) by 533 days.

(21) Appl. No.: 17/760,578

(22) PCT Filed: Sep. 16, 2020

(86) PCT No.: PCT/EP2020/075876
§ 371 (c)(1),
(2) Date: Mar. 15, 2022

(87) PCT Pub. No.: WO2021/053020
PCT Pub. Date: Mar. 25, 2021

(65) Prior Publication Data

US 2022/0400760 A1 Dec. 22, 2022

(30) Foreign Application Priority Data

Sep. 18, 2019 (EP) ..... 19197999

(51) Int. Cl.
*A24F 40/48* (2020.01)
*A24F 40/10* (2020.01)
*A24F 40/46* (2020.01)

(52) U.S. Cl.
CPC ..... *A24F 40/48* (2020.01); *A24F 40/10* (2020.01); *A24F 40/46* (2020.01)

(58) Field of Classification Search
None
See application file for complete search history.

(56) References Cited

U.S. PATENT DOCUMENTS 10,272,170 B2 4/2019 Dubief
10,362,806 B2 7/2019 Cadieux et al.
(Continued)

FOREIGN PATENT DOCUMENTS

CN 207784278 8/2018
EP 3143884 3/2017
(Continued)

OTHER PUBLICATIONS

Office Action issued in Russia for Application No. 2022106767 dated Sep. 29, 2022 (4 pages). English translation included.
(Continued)

*Primary Examiner* — Philip Y Louie
*Assistant Examiner* — Jeffrey A. Buckman
(74) *Attorney, Agent, or Firm* — Mueting Raasch Group

(57) ABSTRACT

The invention relates to an aerosol-generating device. The aerosol-generating device comprises an air inlet. The aerosol-generating device comprises an air outlet. The aerosol-generating device comprises a heating element. The heating element comprises a mesh heater in fluid communication with the air inlet. The aerosol-generating device comprises a first airflow channel extending from the heating element in a first direction along the longitudinal axis of the aerosol-generating device. The aerosol-generating device comprises a second airflow channel arranged downstream of the first airflow channel and extending from the first airflow channel to the air outlet in a second direction. The first direction and the second direction are different from each other.

11 Claims, 2 Drawing Sheets

(56) References Cited

U.S. PATENT DOCUMENTS

| | | | | |
|---|---|---|---|---|
| 11,478,807 | B2 | 10/2022 | Fernando | |
| 2017/0311648 | A1 | 11/2017 | Gill | |
| 2017/0354184 | A1* | 12/2017 | Mironov | A24F 40/48 |
| 2018/0007963 | A1 | 1/2018 | Zhu | |
| 2018/0169357 | A1 | 6/2018 | Reevell | |
| 2018/0242643 | A1 | 8/2018 | Silvesstrini | |
| 2019/0230986 | A1* | 8/2019 | Zinovik | A24D 1/042 |

FOREIGN PATENT DOCUMENTS

| | | |
|---|---|---|
| EP | 3524069 | 8/2019 |
| EP | 3527087 | 8/2019 |
| KR | 10-2017-0094150 | 8/2017 |
| RU | 2616556 | 4/2017 |
| WO | WO 2016/096497 | 6/2016 |
| WO | WO 2016/096745 | 6/2016 |
| WO | WO 2017/068096 | 4/2017 |
| WO | WO 2018/019485 | 2/2018 |
| WO | WO 2019/149424 | 8/2019 |

OTHER PUBLICATIONS

PCT Search Report and Written Opinion for Application No. PCT/EP2020/075876 dated Nov. 9, 2020 (17 pages).
Office Action issued in Korea for Application No. 10-2022-7007190 dated Oct. 8, 2024 (3 pages).
Notice of Opposition for European Application No. 20771863.6 dated Jan. 9, 2026 (6 pages).
Venturi Effect—Wikipedia, https://web.archive.org/web/20190830020637; (6 pages) 2025.

* cited by examiner

AEROSOL-GENERATING DEVICE WITH OFFSET AIRFLOW CHANNEL

This application is a U.S. National Stage Application of International Application No. PCT/EP2020/075876 filed Sep. 16, 2020, which was published in English on Mar. 25, 2021, as International Publication No. WO 2021/053020 A1. International Application No. PCT/EP2020/075876 claims priority to European Application No. 19197999.6 filed Sep. 18, 2019.

The present invention relates to an aerosol-generating device and an aerosol-generating system.

It is known to provide an aerosol-generating device for generating an inhalable vapor. Such devices may heat aerosol-forming substrate to a temperature at which one or more components of the aerosol-forming substrate are volatilised without burning the aerosol-forming substrate. Aerosol-forming substrate may be provided in liquid form in the aerosol-generating device. The aerosol-forming substrate may be provided in a liquid storage portion of the aerosol-generating device or in a replaceable cartridge. For volatilizing the aerosol-forming substrate, a heating element may be provided. The heating element may be a mesh heater. Ambient air may be drawn into the device through an air inlet. The air may be drawn over the mesh heater to entrain the volatilized aerosol-forming substrate so that an aerosol is formed. Subsequently, the aerosol may flow in an airflow channel towards an outlet of a mouthpiece towards a user. The airflow channel between the mesh heater and the outlet of the mouthpiece is commonly a single element. The airflow channel between the mesh heater and the outlet of the mouthpiece is commonly a single element. The airflow channel between the mesh heater and the outlet of the mouthpiece is commonly a straight element, directly connecting the mesh heater and the outlet of the mouthpiece. The airflow channel between the mesh heater and the outlet of the mouthpiece is commonly a non-bent element.

It would be desirable to have an aerosol-generating device with improved aerosol delivery. The invention relates to an aerosol-generating device. The aerosol-generating device comprises an air inlet. The aerosol-generating device comprises an air outlet. The aerosol-generating device comprises a heating element. The heating element comprises a mesh heater in fluid communication with the air inlet. The aerosol-generating device comprises a first airflow channel extending from the heating element in a first direction along the longitudinal axis of the aerosol-generating device. The aerosol-generating device comprises a second airflow channel arranged downstream of the first airflow channel and extending from the first airflow channel to the air outlet in a second direction. The first direction and the second direction are different from each other. The disclosed aerosol-generating device improves aerosol delivery to the user. The present aerosol-generating device provides a more comfortable sensation of the aerosol delivery, in particular in the mouth of the consumer.

The invention may also relate to a mouthpiece comprising the air inlet, air outlet, heating element, first airflow channel and second airflow channel as described herein. In other words, instead of the herein described components being part of an aerosol-generating device, these components may be part of a mouthpiece. The mouthpiece may be configured for an aerosol-generating device, preferably for attachment to an aerosol-generating device.

The aerosol-generating device is provided with at least one air inlet. The air inlet may be a semi-open inlet. The semi-open inlet may be an inlet which permits air or fluid flow in one direction, such as into the device, but at least restricts, preferably prohibits, air or fluid flow in the opposite direction. The semi-open inlet preferably allows air to enter the aerosol-generating device. Air or liquid may be prevented from leaving the aerosol-generating device through the semi-open inlet. The semi-open inlet may for example be a semi-permeable membrane, permeable in one direction only for air, but is air- and liquid-tight in the opposite direction. The semi-open inlet may for example also be a one-way valve. Preferably, the semi-open inlets allow air to pass through the inlet only if specific conditions are met, for example a minimum depression in the aerosol-generating device or a volume of air passing through the valve or membrane.

The air outlet may be an opening in the aerosol-generating device. The user may draw aerosol generated by the aerosol-generating device into the user's mouth. The air outlet may be configured as a mouthpiece or mouth end.

The heating element, in particular the mesh heater, may volatize components of an aerosol-forming substrate. The volatized components may be entrained in the air drawn across the heating element, in particular the mesh heater. The entrained volatized components may form droplets suspended in the air. The entrained volatized components may be absorbed by droplets suspended in the air. Entrainment of the volatized components in the air may lead to the formation of an aerosol. The mesh heater allows for a greater area of the heating element to be in contact with the aerosol-forming substrate to be vaporized. Preferably, the aerosol-forming substrate is a liquid. The aerosol-forming substrate may be arranged on one side of the mesh heater and the air drawn over the mesh heater may be arranged on the opposite side of the mesh heater. The aerosol-forming substrate may be arranged on a distal side of the mesh heater. The air drawn over the mesh heater may be arranged on a proximal side of the mesh heater. The mesh heater may be centrally arranged on the longitudinal axis of the aerosol-generating device.

The first airflow channel may be a tube. The first airflow channel may have a cylindrical shape, preferably a hollow cylindrical shape. The first airflow channel may have a circular cross-section. The first airflow channel may have a rectangular cross-section. The first airflow channel may have a polygonal cross-section. The first airflow channel may have a rectangular, elliptical or oval cross-section. The first airflow channel may have a polygonal cross-section. The first airflow channel may direct air from the heating element to the second airflow channel. The first airflow channel may direct the components volatized by the heating element and entrained in the ambient air drawn through the air inlet towards the second airflow channel.

The cross-sectional area of the first airflow channel may be constant. The first airflow channel may be a cylinder having a constant diameter along the length of the cylinder. The cross-sectional area of the first airflow channel may increase in the downstream direction. Such increase of cross-sectional area may be continuous in the downstream direction. The increase of cross-sectional area may be stepwise in the downstream direction.

The first airflow channel may extend at least partially in the longitudinal direction of the aerosol-generating device. The first airflow channel may extend at least partially along the longitudinal axis of the aerosol-generating device. The term 'along' may refer to the first airflow channel extending directly on the longitudinal axis of the aerosol-generating device. The term 'along' may further refer to the first airflow channel extending parallel to the longitudinal axis of the aerosol-generating device.

The first airflow channel may be arranged laterally offset from the longitudinal axis of the aerosol-generating device. The first airflow channel may be parallel to the longitudinal axis of the aerosol-generating device. The first airflow channel may distant from the longitudinal axis of the aerosol-generating device. The first airflow channel may be distant from the longitudinal axis of the aerosol-generating device and parallel to the longitudinal axis of the aerosol-generating device. The center of the first airflow channel may be arranged laterally offset from the longitudinal axis of the aerosol-generating device. The center of the first airflow channel may be distant from the longitudinal axis of the aerosol-generating device. The center of the first airflow channel may be the longitudinal axis of the first airflow channel. For example, the center of a cylindrical first airflow channel may be the longitudinal axis of the cylinder. The longitudinal axis of the first airflow channel may be parallel to the longitudinal axis of the aerosol-generating device. The center of the first airflow channel may be the centroid of the upstream end face of first airflow channel. The centroid of the upstream end face of the first airflow channel may be the arithmetic mean position of all the points in the upstream end face of the first airflow channel. For example, the end face of a cylindrical first airflow channel may be circular. The centroid of such circular end face may be the point equidistant from each point along the edge of the circular end face. The lateral offset of the center of the first airflow channel from the longitudinal axis of the aerosol-generating device may be such that the direction of airflow drawn across the mesh heater is changed by approximately 90°.

The first airflow channel may comprise a wall. The wall of the first airflow channel may surround a volume of air. The wall of the first airflow channel may define the shape of the first airflow channel. The wall of the first airflow channel may define the contours of the first airflow channel. The wall may form a cylinder. The wall may comprise a first face directed towards the longitudinal axis of the aerosol-generating device and a second face directed away from the longitudinal axis of the aerosol-generating device. In other words, the first wall may be an inward facing wall and the second wall may be a wall opposite the first wall. In preferred embodiments, the first face is directly above the mesh heater and the second face is radially outside of the mesh heater.

The first airflow channel may be lined with a liquid absorbing lining. The lining may comprise a porous material. The porosity of the lining may change in the downstream direction. Preferably, the porosity of the lining changes continuously in the downstream direction. The porosity may increase in the downstream direction. In this way, condensates forming in the first airflow channel may be funneled back towards heating element. In other words, capillarity of the lining may decrease in the downstream direction.

The second airflow channel may be a tube. The second airflow channel may have a cylindrical shape, preferably a hollow cylindrical shape. The second airflow channel may have a circular cross-section. The second airflow channel may have a rectangular cross-section. The second airflow channel may have a polygonal, oval or elliptical cross-section. The second airflow channel may be a truncated cone. The second airflow channel may be an asymmetrically distorted truncated cone. The second airflow channel may be a truncated cone asymmetrically distorted towards the longitudinal axis of the aerosol-generating device. The cross-sectional area of the second airflow channel may constant in a downstream direction. The cross-sectional area of the second airflow channel may increase in a downstream direction. The cross-sectional area of the second airflow channel may increase continuously in the downstream direction. The cross-sectional area of the second airflow channel may increase stepwise in the downstream direction. The cross-sectional area of the second airflow channel may increase in one step in the downstream direction. The vertical cross-section of the second airflow channel may be triangular. The second airflow channel may direct air from the first airflow channel to the air outlet. The downstream end face of the second airflow channel may be centrally arranged on the longitudinal axis of the aerosol-generating device. The second airflow channel may be shaped to direct the airflow laterally towards the longitudinal axis of the aerosol-generating device. In this way, an aerosol may be delivered to the user drawing on the air outlet centrally on the aerosol-generating device. The central delivery of the aerosol may reduce the size of the aerosol-generating device.

The difference of the first direction in which the first airflow channel extends and the second direction in which the second airflow channel extends may be defined by an inclination between the first direction and the second direction. Herein, the term "inclined" or "inclination" may indicate that the first direction and second direction may not be parallel to each other. In other words, the term "inclined" or "inclination" may indicate that the angle between the first direction and the second direction is not zero. The difference of the first direction in which the first airflow channel extends and the second direction in which the second airflow channel extends may be defined by an inclination between the first airflow channel with respect to the second airflow channel. The first direction may be the direction along the longitudinal axis of the first airflow channel. The second direction may be the direction along the longitudinal axis of the second airflow channel. The difference of the first direction in which the first airflow channel extends and the second direction in which the second airflow channel extends may be defined by an inclination between the longitudinal axis of the first airflow channel with respect to the longitudinal axis of the second airflow channel. The first airflow channel may be laterally offset from the longitudinal axis of the aerosol-generating device and the second airflow channel may be inclined with respect to the first airflow channel. The longitudinal axis of the first airflow channel may be laterally offset from the longitudinal axis of the aerosol-generating device and the longitudinal axis of the second airflow channel may be inclined with respect to the longitudinal axis of the first airflow channel. The longitudinal axis of the first airflow channel may be distant from the longitudinal axis of the aerosol-generating device and the longitudinal axis of the second airflow channel may be inclined with respect to the longitudinal axis of the first airflow channel. The second airflow channel may be inclined towards the longitudinal axis of the aerosol-generating device. The longitudinal axis of the second airflow channel may be inclined towards the longitudinal axis of the aerosol-generating device.

The second airflow channel may be lined with a liquid absorbing lining similar to the lining described above. The lining may be configured such that aerosol droplets contacting the lining may be absorbed by the lining and transported in an upstream direction through the lining by capillary action.

The aerosol-generating device may comprise a third airflow channel. The third airflow channel may extent between the air inlet and the heating element. The third airflow channel may be a tube. The third airflow channel may be a straight tube. The third airflow channel may be a bent tube. The third airflow channel may have a cylindrical shape, preferably a hollow cylindrical shape. The third airflow channel may have a circular cross-section. The third airflow channel may have a rectangular cross-section. The cross-sectional area of the third airflow channel may be constant along its length. The cross-sectional area of the third airflow channel may increase towards the downstream end of the third airflow channel. Such increase may maximise the area of the mesh heater impacted by the flow of ambient air delivered through the third airflow channel. The cross-sectional area of the third airflow channel may decrease towards the downstream end of the third airflow channel. The third airflow channel directs air from the air inlet towards the heating element.

The third airflow channel may be inclined with respect to the longitudinal axis of the aerosol-generating device. The longitudinal axis of the third airflow channel may be inclined with respect to the longitudinal axis of the aerosol-generating device. Herein, the term "inclined" may indicate that the longitudinal axis of the third airflow channel may not be parallel to the longitudinal axis of the aerosol-generating device. In other words, the term "inclined" may indicate that the angle between the longitudinal axis of the third airflow channel and the longitudinal axis of the aerosol-generating device is not zero. The third airflow channel may be perpendicularly arranged to the longitudinal axis of the aerosol-generating device. In a preferred embodiment, the longitudinal axis of the third airflow channel may be perpendicular to the longitudinal axis of the aerosol-generating device. The inclination of the longitudinal axis of the third airflow channel may optimize the delivery of the airflow to the heating element or mesh heater.

The third airflow channel may be arranged to draw ambient air across the heating element. The inclination of the longitudinal axis of the third airflow channel to the longitudinal axis of the aerosol-generating device may result in ambient air being drawn across the mesh heater. Due to the inclination of the longitudinal axis of the third airflow channel the airflow may be directed towards a particular part of the heating element. Due to the inclination of the longitudinal axis of the third airflow channel, the airflow may be directed towards the upstream end of the heating element. The upstream end of the mesh heater may be the part of the mesh heater which is located at a maximum distance to the first airflow channel. Due to the inclination of the longitudinal axis of the third airflow channel the airflow may be delivered to the heating element at a particular angle. The third airflow channel may be arranged such that air is drawn over the full length of the heating element.

The third airflow channel may be shaped to direct the flow of ambient air across the mesh heater. The third airflow channel may be shaped such that the flow of ambient air delivered through the third airflow channel may impact the mesh heater at an inclined angle to the surface of the mesh heater. In this way, the flow of ambient air delivered through the third airflow channel impacts the mesh heater at an angle to the surface of the heating element. The third airflow channel may be shaped or arranged to direct the ambient air across the entire extension of the heating element or mesh heater perpendicular of the longitudinal axis of the aerosol-generating device. The third airflow channel may be arranged to draw ambient air across the heating element. By arranging or shaping the third airflow channel such that ambient air is drawn across the heating element or mesh heater, components volatized by the mesh heater may be entrained in the ambient air drawn across the mesh heater. In this way, the amount of components volatized by the mesh heater that becomes entrained by the ambient air drawn across the mesh heater is maximised. Particularly, air may be drawn in a lateral direction through the third airflow channel. The mesh heater is preferably arranged and extends perpendicular to the longitudinal axis of the aerosol-generating device. Consequently, the air may be drawn laterally over the surface of the mesh heater, preferably over the full surface of the mesh heater.

The third airflow channel may be connected to the first airflow channel. The downstream end of the third airflow channel may be connected to the upstream end of the first airflow channel. Between the first airflow channel and the third airflow channel, an L-shaped bend may be provided. The L-shaped bend may be part of the downstream end of the third airflow channel or the upstream end of the first airflow channel. The portion of the L-shaped bend parallel or along the longitudinal axis of the aerosol-generating device may be part of the first airflow channel. The portion of the L-shaped bend perpendicular to the longitudinal axis of the aerosol-generating device may be part of the third airflow channel.

The heating element may be flat. The heating element may be substantially flat. The heating element may be arranged in a flat plane. The heating element may substantially be two-dimensional. The heating element may have a smooth surface. The flat plane may be perpendicularly arranged to the longitudinal axis of the aerosol-generating device. The flatness of the heating element may result in the airflow across the heating element being substantially unobstructed. In this way, the airflow across the heating element may be uniform. A flat heating element can be easily handled during manufacture and provides for a robust construction.

The heating element may be configured as an electrically resistive metal heater. Suitable electrically resistive materials include but are not limited to: semiconductors such as doped ceramics, electrically "conductive" ceramics (such as, for example, molybdenum disilicide), carbon, graphite, metals, metal alloys and composite materials made of a ceramic material and a metallic material. Such composite materials may comprise doped or undoped ceramics. Examples of suitable doped ceramics include doped silicon carbides. Examples of suitable metals include titanium, zirconium, tantalum platinum, gold and silver. Examples of suitable metal alloys include stainless steel, nickel-, cobalt-, chromium-, aluminium-titanium-zirconium-, hafnium-, niobium-, molybdenum-, tantalum-, tungsten-, tin-, gallium-, manganese-, gold- and iron-containing alloys, and superalloys based on nickel, iron, cobalt, stainless steel, Timetal® and iron-manganese-aluminium based alloys. In composite materials, the electrically resistive material may optionally be embedded in, encapsulated or coated with an insulating material or vice-versa, depending on the kinetics of energy transfer and the external physicochemical properties required. The heating element configured as an electrically resistive metal heater is robust, easy to manufacture and cost-effective. Hence, implementation of such mesh heater reduces the cost and maintenance of the aerosol-generation device.

The heating element may be fluid permeable and may comprise a plurality of electrically conductive filaments. As used herein "fluid permeable" in relation to a heating element means that the aerosol-forming substrate, in a gaseous phase and possibly in a liquid phase, can readily pass through the heating element. The filaments may form a mesh heater. The filaments may comprise a woven or non-woven fabric. The filaments allow for a greater area of the heating element to be in contact with the aerosol-forming substrate to be vaporized.

The heating element may comprise a mesh having interstices between the electrically conductive filaments. The electrically conductive filaments may define interstices between the filaments and the interstices may have a width of between 10 μm and 100 μm. Preferably the filaments give rise to capillary action in the interstices, so that in use, liquid aerosol-forming substrate to be vaporized is drawn into the interstices, increasing the contact area between the heating element and the liquid. The electrically conductive filaments may form a mesh of size between 160 and 600 Mesh US (+/−10%) (i.e. between 160 and 600 filaments per inch (+/−10%)). The width of the interstices is preferably between 75 μm and 25 μm. The percentage of open area of the mesh, which is the ratio of the area of the interstices to the total area of the mesh is preferably between 25 and 56%. The mesh may be formed using different types of weave or lattice structures. Alternatively, the electrically conductive filaments consist of an array of filaments arranged parallel to one another.

The mesh of electrically conductive filaments may also be characterized by its ability to retain liquid, as is well understood in the art.

The electrically conductive filaments may have a diameter of between 8 μm and 100 μm, preferably between 8 μm and 50 μm, and more preferably between 8 μm and 39 μm. The filaments may have a round cross-section or may have for example a flattened cross-section. The area of the mesh of electrically conductive filaments of a single heating element may be small, preferably less than or equal to 25 mm, allowing it to be incorporated into a handheld system. The heating element may, for example, be rectangular and have a length of about 5 mm and a width of about 2 mm. In some examples, the width is below 2 mm, for example the width is about 1 mm.

The electrically conductive filaments may comprise any suitable electrically conductive material. Suitable materials include but are not limited to: semiconductors such as doped ceramics, electrically "conductive" ceramics (such as, for example, molybdenum disilicide), carbon, graphite, metals, metal alloys and composite materials made of a ceramic material and a metallic material. Such composite materials may comprise doped or undoped ceramics. Examples of suitable doped ceramics include doped silicon carbides. Examples of suitable metals include titanium, zirconium, tantalum and metals from the platinum group. Examples of suitable metal alloys include stainless steel, constantan, nickel-, cobalt-, chromium-, aluminiumtitanium-zirconium-, hafnium-, niobium-, molybdenum-, tantalum-, tungsten-, tin-, gallium-, manganese- and iron-containing alloys, and super-alloys based on nickel, iron, cobalt, stainless steel, Timetal®, iron-aluminium based alloys and iron-manganese-aluminium based alloys. Timetal® is a registered trade mark of Titanium Metals Corporation. The filaments may be coated with one or more insulators. Preferred materials for the electrically conductive filaments are 304, 316, 304L, and 316L stainless steel, and graphite.

The electrical resistance of the mesh of electrically conductive filaments of the heating element is preferably between 0.3 and 4 Ohms. More preferably, the electrical resistance of the mesh of electrically conductive filaments is between 0.5 and 3 Ohms, and more preferably about 1 Ohm. It is generally advantageous to have a low overall resistance for the heating element if the system is powered by a battery.

The heating element may comprise at least one filament made from a first material and at least one filament made from a second material different from the first material. This may be beneficial for electrical or mechanical reasons. For example, one or more of the filaments may be formed from a material having a resistance that varies significantly with temperature, such as an iron aluminium alloy. This allows a measure of resistance of the filaments to be used to determine temperature or changes in temperature. This can be used in a puff detection system and for controlling heater temperature to keep it within a desired temperature range.

The aerosol-generating device may comprise a liquid storage portion. The liquid storage portion may comprise an aerosol-forming substrate. The liquid storage portion may comprise an opening and the mesh heater may be arranged extending across the opening. In this way, wetting of the heating element by the liquid aerosol-forming substrate and spreading of the liquid aerosol-forming substrate on the heating element may be optimized.

The liquid storage portion is adapted for storing the liquid aerosol-forming substrate to be supplied to the heating element. The liquid storage portion may be configured as a container or a reservoir for storing the liquid aerosol-forming substrate.

Preferably, the liquid storage portion is capable of being coupled to the heating element by a respective coupling hermetically sealed against surrounding atmosphere. Preferably, the couplings are configured as self-healing pierceable membranes. The membranes avoid undesired leaking of the liquid aerosol-forming substrate stored in the liquid storage portion. The liquid storage portion may be configured as a replaceable tank or container. For coupling the replaceable liquid storage portion to the heating element a respective needle-like hollow tube may be pierced through a respective membrane. When the heating element is coupled to the liquid storage portion, the membranes avoid undesired leaking of the liquid aerosol-forming substrate and leaking of air from and into the liquid storage portion.

As used herein, the term 'aerosol-forming substrate' relates to a substrate capable of releasing one or more volatile compounds that can form an aerosol. Such volatile compounds may be released by heating the aerosol-forming substrate. An aerosol-forming substrate may conveniently be part of an aerosol-generating article or smoking article or preferably provided in a liquid storage portion within the aerosol-generating device.

The aerosol-forming substrate may comprise plant-based material. The aerosol-forming substrate may comprise tobacco. The aerosol-forming substrate may comprise a tobacco-containing material containing volatile tobacco flavour compounds, which are released from the aerosol-forming substrate upon heating. The aerosol-forming substrate may alternatively comprise a non-tobacco-containing material. The aerosol-forming substrate may comprise homogenised plant-based material. The aerosol-forming substrate may comprise homogenised tobacco material.

The aerosol-forming substrate may comprise at least one aerosol-former. An aerosol-former is any suitable known compound or mixture of compounds that, in use, facilitates formation of a dense and stable aerosol and that is substantially resistant to thermal degradation at the temperature of operation of the system. Suitable aerosol-formers are well known in the art and include, but are not limited to: polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. Aerosol formers may be polyhydric alcohols or mixtures thereof, such as triethylene glycol, 1,3-butanediol and glycerine. The aerosol-former may be propylene glycol. The aerosol former may comprise both glycerine and propylene glycol.

The aerosol-forming substrate may be provided in a liquid form. The liquid aerosol-forming substrate may comprise other additives and ingredients, such as flavourants. The liquid aerosol-forming substrate may comprise water, solvents, ethanol, plant extracts and natural or artificial flavours. The liquid aerosol-forming substrate may comprise nicotine. The liquid aerosol-forming substrate may have a nicotine concentration of between about 0.5% and about 10%, for example about 2%. The liquid aerosol-forming substrate may be contained in the liquid storage portion.

The aerosol-generating device may comprise a power supply, typically a battery, within a main body of the aerosol-generating device. In one embodiment, the power supply is a Lithium-ion battery. Alternatively, the power supply may be a Nickel-metal hydride battery, a Nickel cadmium battery, or a Lithium based battery, for example a Lithium-Cobalt, a Lithium-Iron-Phosphate, Lithium Titanate or a Lithium-Polymer battery. As an alternative, the power supply may be another form of charge storage device such as a capacitor. The power supply may require recharging and may have a capacity that enables to store enough energy for one or more usage experiences; for example, the power supply may have sufficient capacity to continuously generate aerosol for a period of around six minutes or for a period of a multiple of six minutes. In another example, the power supply may have sufficient capacity to provide a predetermined number of puffs or discrete activations of the heating element.

Operation of the heating element may be triggered by a puff detection system. Alternatively, the vaporiser may be triggered by pressing an on-off button, held for the duration of the user's puff. The puff detection system may be provided as a sensor, which may be configured as an airflow sensor to measure the airflow rate. The airflow rate is a parameter characterizing the amount of air that is drawn through the airflow path of the aerosol-generating device per time by the user. The initiation of the puff may be detected by the airflow sensor when the airflow exceeds a predetermined threshold. Initiation may also be detected upon a user activating a button.

The sensor may be configured as a pressure sensor to measure the pressure of the air inside the aerosol-generating device which is drawn through the airflow path of the device by the user during a puff. The sensor may be configured to measure a pressure difference or pressure drop between the pressure of ambient air outside of the aerosol-generating device and of the air which is drawn through the device by the user. The pressure of the air may be detected at the air inlet, the air outlet of the device or any other passage or chamber within the aerosol-generating device, through which the air flows. When the user draws on the aerosol-generating device, a negative pressure or vacuum is generated inside the device, wherein the negative pressure may be detected by the pressure sensor. The term "negative pressure" is to be understood as a pressure which is relatively lower than the pressure of ambient air. In other words, when the user draws on the device, the air which is drawn through the device has a pressure which is lower than the pressure off ambient air outside of the device. The initiation of the puff may be detected by the pressure sensor if the pressure difference exceeds a predetermined threshold.

As used herein, an 'aerosol-generating device' relates to a device that interacts with an aerosol-forming substrate to generate an aerosol. The aerosol-forming substrate may be part of an aerosol-generating article, for example part of a smoking article. Preferably, however, the aerosol-forming substrate is provided in liquid form in a liquid storage portion of the aerosol-generating device. The aerosol-generating device may be a smoking device that interacts with the aerosol-forming substrate to generate an aerosol that is directly inhalable into a user's lungs thorough the user's mouth. The aerosol-generating device may be a holder. The device may be an electrically heated smoking device. The aerosol-generating device may comprise a housing, electric circuitry, a power supply, a heating chamber and a heating element.

The aerosol-generating device may comprise electric circuitry. The electric circuitry may comprise a microprocessor, which may be a programmable microprocessor. The microprocessor may be part of a controller. The electric circuitry may comprise further electronic components. The electric circuitry may be configured to regulate a supply of power to the heating element. Power may be supplied to the heating element continuously following activation of the aerosol-generating device or may be supplied intermittently, such as on a puff-by-puff basis. The power may be supplied to the heating element in the form of pulses of electrical current. The electric circuitry may be configured to monitor the electrical resistance of the heating element, and preferably to control the supply of power to the heating element dependent on the electrical resistance of the heating element.

The invention further relates to an aerosol-generating system comprising an aerosol-generating device as described herein.

The aerosol-generating system may be an electrically operated smoking system. Preferably, the aerosol-generating system is portable. The aerosol-generating system may have a size comparable to a conventional cigar or cigarette.

As used herein, the terms 'upstream', 'downstream', 'proximal' and 'distal' are used to describe the relative positions of components, or portions of components, of the aerosol-generating device in relation to the direction in which a user draws on the aerosol-generating device during use thereof.

The aerosol-generating system may comprise a mouth end or air outlet through which in use an aerosol exits the aerosol-generating system and is delivered to a user. The mouth end may also be referred to as the proximal end. In use, a user draws on the proximal or mouth end of the aerosol-generating system in order to inhale an aerosol generated by the aerosol-generating system. The aerosol-generating system comprises a distal end opposed to the proximal or mouth end. The air outlet of the aerosol-generating system may also be referred to as the downstream end and the distal end of the aerosol-generating system may also be referred to as the upstream end. Components or portions of components, of the aerosol-generating system may be described as being upstream or downstream of one another based on their relative positions between the air outlet, proximal, downstream or mouth end and the distal or upstream end of the aerosol-generating system.

The system may comprise a capillary material in contact with the heating element and the liquid storage portion. The capillary material may be arranged inside of the liquid storage portion. The capillary material may have a fibrous or spongy structure. The capillary material preferably comprises a bundle of capillaries. For example, the capillary material may comprise a plurality of fibres or threads or other fine bore tubes. The fibres or threads may be generally aligned to convey liquid aerosol-forming substrate to the heating element. Alternatively, the capillary material may comprise sponge-like or foam-like material. The structure of the capillary material forms a plurality of small bores or tubes, through which the liquid can be transported by capillary action. The capillary material may comprise any suitable material or combination of materials. Examples of suitable materials are a sponge or foam material, ceramic- or graphite-based materials in the form of fibres or sintered powders, foamed metal or plastics materials, a fibrous material, for example made of spun or extruded fibres, such as cellulose acetate, polyester, or bonded polyolefin, polyethylene, ethylene or polypropylene fibres, nylon fibres or ceramic. The capillary material may have any suitable capillarity and porosity so as to be used with different liquid physical properties. The liquid has physical properties, including but not limited to viscosity, surface tension, density, thermal conductivity, boiling point and vapour pressure, which allow the liquid to be transported through the capillary material by capillary action. The capillary material may be configured to convey the aerosol-forming substrate to the heating element. The capillary material may extend into interstices in the between the electrically conductive filaments.

Features described in relation to one embodiment may equally be applied to other embodiments of the invention.

The invention will be further described, by way of example only, with reference to the accompanying drawings in which.

Figure 1:
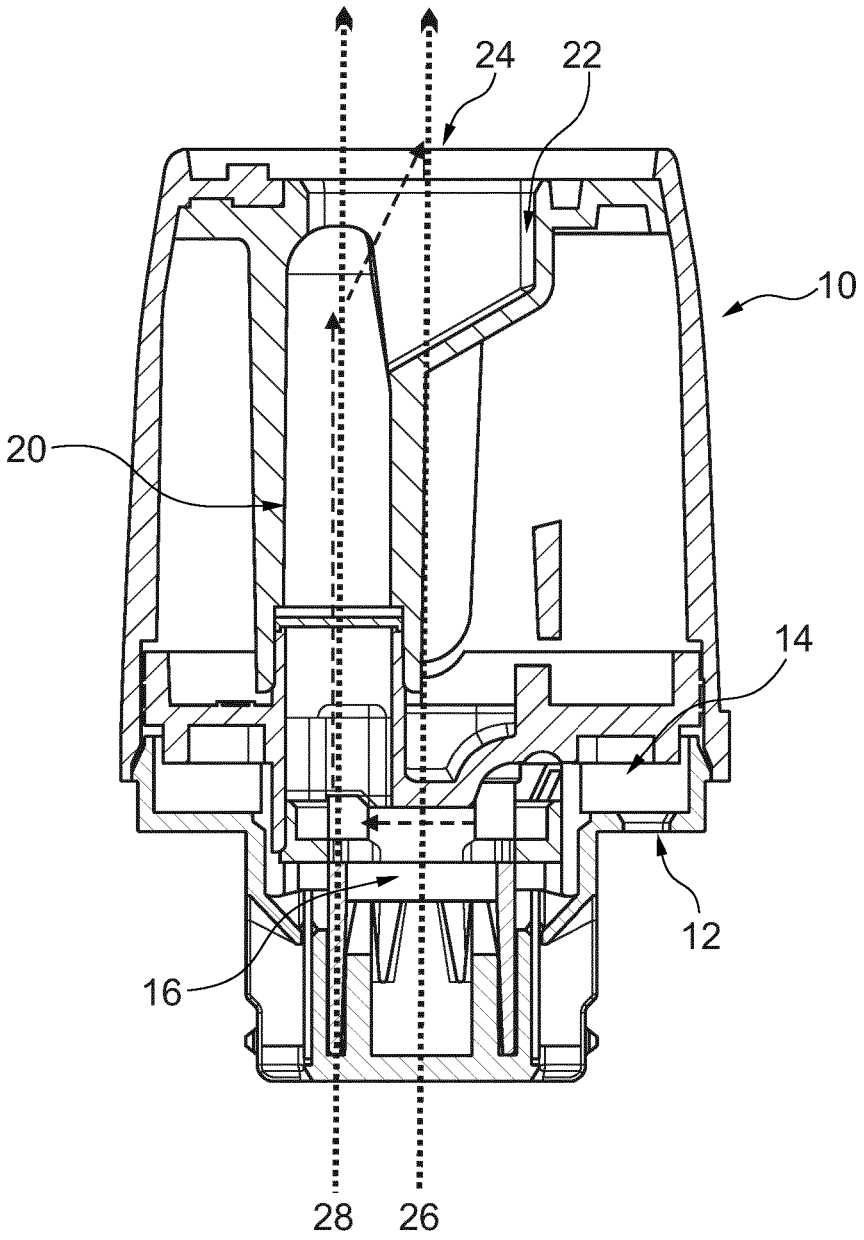
FIG. 1 shows a mouthpiece of an aerosol-generating device according to the invention.

FIG. 1 shows a mouthpiece 10 of the aerosol-generating device according to the invention. In operation, a consumer draws on an air outlet 24 which causes an airflow from an air inlet 12 to the air outlet 24. The flow path of the airflow from the air inlet 12 to the air outlet 24 is indicated by the series of dashed line arrows. The aerosol-generating device comprises the air inlet 12 and a third airflow channel 14. Air may be drawn into the aerosol-generating device though the air inlet 12. The air drawn into the air inlet 12 then enters the third airflow channel 14. The air is guided through the third airflow channel 14 towards the heating element 16. The third airflow channel 14 is substantially perpendicular to the longitudinal axis 26 of the aerosol-generating device. The heating element 16 is substantially flat and extends perpendicular to the longitudinal axis 26 of the aerosol-generating device. The heating element 16 is configured as a mesh heater. The heating element 16 may have a circular or rectangular shape. The air is directed across the heating element 16 towards a first airflow channel 20. The heating element 16 volatizes at least one component of an aerosol-forming substrate (not shown). The aerosol-forming substrate may be delivered to the heating element 16 by a capillary material (not shown). The volatized component may be entrained in the air being drawn across the heating element 16. In this way, an aerosol may be formed. The aerosol may flow from the heating element 16 towards and into the first airflow channel 20. Between the heating element 16 and the first airflow channel 20, the air flows in an L-shaped bend. The L-shaped bend may be part of the downstream end of the third airflow channel 14 or of the first airflow channel 20. The first airflow channel 20 may be cylindrically-shaped with a constant diameter along the length of the first airflow channel 20. The longitudinal axis 28 in the center of the cylindrical first airflow channel 20 is laterally offset from the longitudinal axis 26 of the aerosol-generating device. The first airflow channel 20 is laterally offset from the longitudinal axis of the aerosol-generating device such that the longitudinal axis 28 of the first airflow channel 20 is arranged to be laterally offset from the center of the heating element 16. The center of the heating element 16 may be the point that is equidistant from the edge of the heating element 16 or the geometric center of the heating element 16. Due to the relative arrangement of the first airflow channel 20 and the heating element 16, the direction of the airflow changes by 90° when the air enters the first airflow channel 20, such that the flow path may be described to be L-shaped as the air enters the first airflow channel 20.

The airflow is then guided through the first airflow channel 20 into a second airflow channel 22. The cross-sectional area of the second airflow channel 22 increases towards the downstream direction. The second airflow channel 22 is a funnel-shaped or cone-shaped structure, which widens as the second airflow channel 22 extends towards the air outlet 24. The increase in cross-sectional area towards the downstream direction is such that the end face of the second airflow channel 22 adjacent to the air outlet 24 is centrally arranged on the longitudinal axis 26 of the aerosol-generating device. The widening of the second airflow channel 22 may give rise to a Venturi effect improving the properties of the aerosol. In this regard, the first airflow channel 20 may be a constricted section, while the second airflow channel 22 may enable expansion of the aerosol, thereby potentially cooling the aerosol and improving droplet formation. The airflow is guided through the second airflow channel 22 to the air outlet 24. A consumer may inhale aerosol delivered through the air outlet 24. A main body (not shown) comprising a power supply and a controller may be attached to mouthpiece 10.

Figure 2:
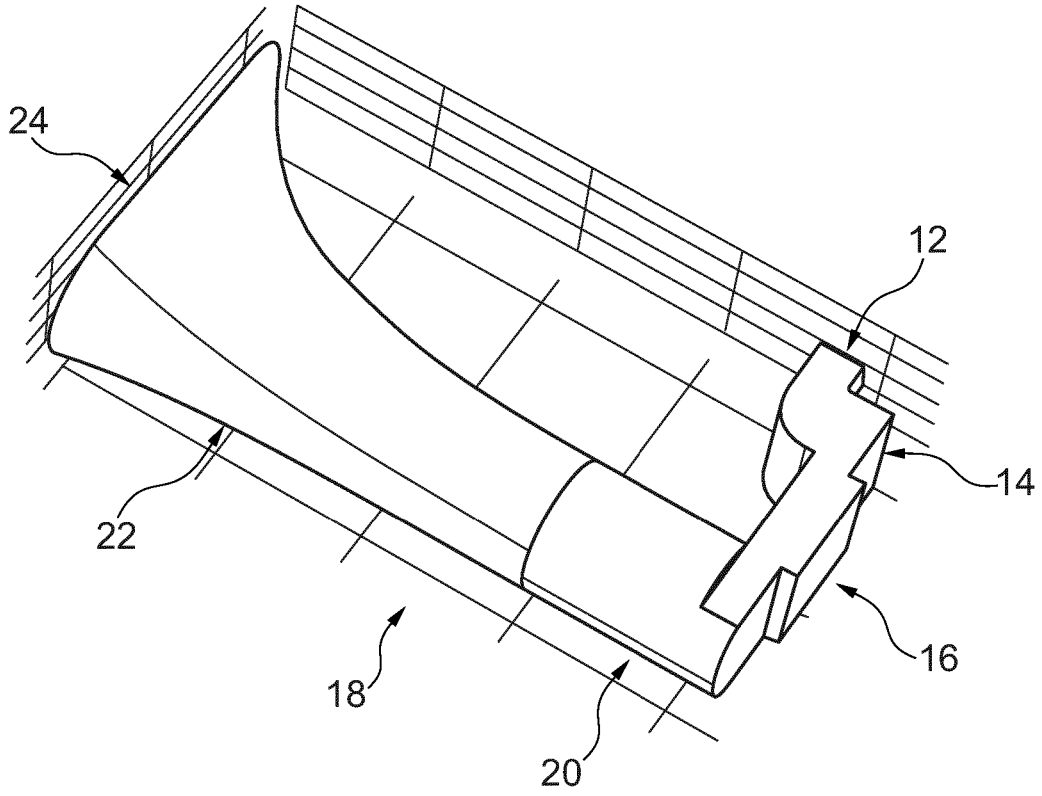
FIG. 2 illustrates an embodiment of the aerosol-generating device according to invention.

FIG. 2 shows an embodiment of the aerosol-generating device according to invention, particularly of the third airflow channel 14, the first airflow channel 20 and the second airflow channel 22. The structure and the function of the components are essentially the same as those described in FIG. 1.

The invention claimed is:

1. An aerosol-generating device comprising:

an air inlet;

an air outlet;

a heating element, wherein the heating element comprises a mesh heater in fluid communication with the air inlet;

a first airflow channel extending from the heating element in a first direction along a longitudinal axis of the aerosol-generating device;

a second airflow channel arranged downstream of the first airflow channel and extending from the first airflow channel to the air outlet in a second direction, wherein the first direction and the second direction are different from each other, wherein a cross-sectional area of the second airflow channel increases in a downstream direction, and wherein a downstream end face of the second airflow channel defines a maximum cross-sectional area of the second airflow channel; and a third airflow channel perpendicularly arranged to the longitudinal axis of the aerosol-generating device and extending between the air inlet and the heating element to draw ambient air across the heating element.

2. The aerosol-generating device according to claim 1, wherein the first airflow channel is arranged laterally offset from the longitudinal axis of the aerosol-generating device.

3. The aerosol-generating device according to claim 1, wherein the third airflow channel is inclined with respect to the longitudinal axis of the aerosol-generating device.

4. The aerosol-generating device according to claim 1, wherein the first airflow channel has a circular cross-section.

5. The aerosol-generating device according to claim 1, wherein the second airflow channel is shaped to direct the airflow laterally towards the longitudinal axis of the aerosol-generating device.

6. The aerosol-generating device according to claim 1, wherein the downstream end face of the second airflow channel is centrally arranged on the longitudinal axis of the aerosol-generating device.

7. The aerosol-generating device according to claim 1, wherein the mesh heater is centrally arranged on the longitudinal axis of the aerosol-generating device.

8. The aerosol-generating device according to claim 1, wherein the heating element is substantially flat.

9. The aerosol-generating device according to claim 1, wherein the heating element is configured as an electrically resistive metal heater.

10. The aerosol-generating device according to claim 1, wherein the aerosol-generating device comprises a liquid storage portion, wherein the liquid storage portion comprises an opening and wherein the mesh heater is arranged extending across the opening.

11. An aerosol-generating system comprising the aerosol-generating device according to claim 1 and an aerosol-forming substrate.

* * * * *